United States Patent [19]

Sheth

[11] 3,987,977

[45] Oct. 26, 1976

[54] SKEWER ASSEMBLY

[76] Inventor: Narottam Vrajlal Sheth, 146A Jain Society, Sion, Bombay-400 022, India

[22] Filed: Apr. 15, 1975

[21] Appl. No.: 568,372

[52] U.S. Cl. ..... 242/130.4

[51] Int. Cl.[2] ..... B65H 49/02; D03J 5/08

[58] Field of Search ..... 242/130, 130.4, 72 R, 242/72.1, 129.7, 129.71, 129.5; 294/5.5, 93, 94, 95

[56] References Cited

UNITED STATES PATENTS 3,617,011 11/1971 Kostelecky et al. ..... 242/130

*Primary Examiner*—Leonard D. Christian

*Attorney, Agent, or Firm*—Haseltine, Lake & Waters

[57] ABSTRACT

A skewer assembly comprising upper and lower portions threadably connected together and extending axially along a longitudinal axis, the upper portion having a tapered end, the lower portion having a sleeve with a bush for engaging a rotatable crank pin of a Barber Colman spool winding machine. A cam rides in the lower tubular portion and is actuated by the crank pin so as to undergo upward and downward movement. The upper tubular portion is provided with a plurality of longitudinal slots distributed around the circumference of the upper portion and holding dogs are pivotably mounted in the slots and are actuated by a spindle which is secured to the cam to follow the movement thereof. The dogs are thus pivotably moved between retracted and extended positions for selectively holding and releasing a bobbin on the skewer. Each of the dogs has a first end region with a convexly bent portion having an extremity extending obliquely relative to the longitudinal axis radially inwardly and axially upwardly to form a guide for a bobbin as it is received by the skewer assembly.

13 Claims, 18 Drawing Figures

FIG. 7
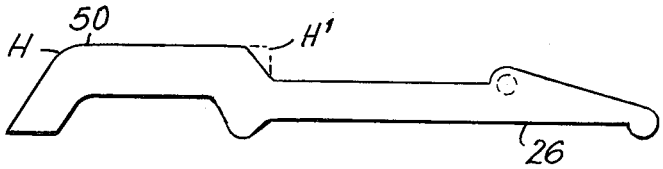
FIG. 8
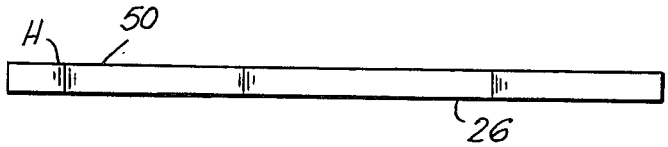
FIG. 9
PRIOR ART
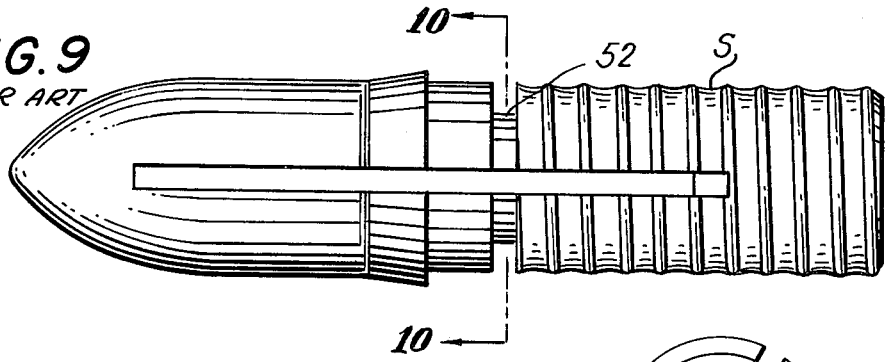
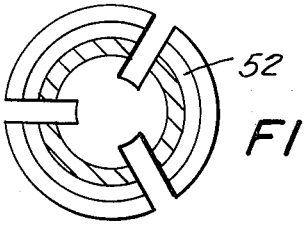
FIG. 10
FIG. 11
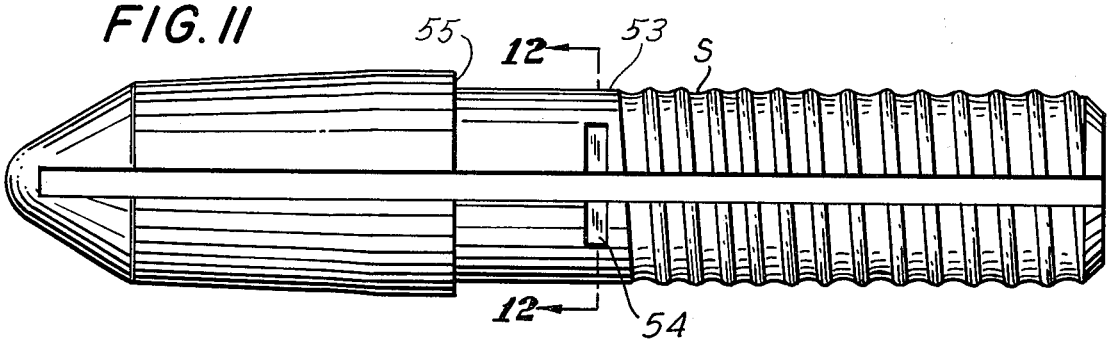
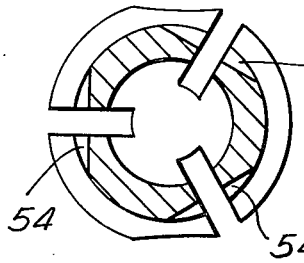
FIG. 12

SKEWER ASSEMBLY

FIELD OF THE INVENTION

The present invention relates to improvements in skewer assemblies for spool winding machines and, more particularly, those which are usually fitted on Barber Colman spool winding machines.

DISCUSSION OF THE PRIOR ART

The presently known skewer assemblies are subject to a number of drawbacks and disadvantages.

The yarn tube or the like is held by the tapered end of the skewer proper, on which is located holding and releasing means which are adjusted by the upward and downward movements of the spindle through intermediary of two cones which are formed thereon. The prior art skewer usually has a set of three holding members which are quite short in length. Due to this limitation of length, several skewer assemblies are required for holding yarn tubes or the like having different diameters. This, as a result, requires frequent changes of the skewer assembly for use with different types of yarn tube.

The head of each of the holding members is flat so that a gap remains between the holding member and the top of the tapered end of the existing skewer assembly. At times this obstructs the passage of the yarn tube, causing an impact and resulting in throwing out of the full yarn tube instead of receiving and retaining the latter. Due to the above-mentioned gap, the yarn tubes become trapped between the tapered end of the skewer and holding member which will of necessity, damage the tubes.

The yarn tube also is supported on the bottom part of the tapered end of the skewer so that the edges of the holding member grip the inside of the tube placed on the latter. The shorter the distance between the gripping line of the holding member within the yarn tube and the supporting line of the bottom within this tube in the assembly head, the greater becomes the danger of the tube being maintained in a tilted or inclined position or, in effect, out of alignment with the path of the yarn. Due to this tilting, the yarn will then rub against the top of the tube and causing the yarn to break, layers of additional yarn on the tube are thus wasted and machine operating time is lost, there resulting in a consequent loss of production.

Another drawback and disadvantage of the prior art skewer assembly lies in that the tapered head of this assembly has a circular groove which is adapted to receive fulcruming dowels for the holding member. This makes the thickness of the member section between this groove and the bore of the tip very thin, in turn reducing the strength of the tip as a whole and consequently limiting the bore diameter of the tip. It is not possible to increase the diameter of the bore of the tip and also of the inside spindle, thereby prohibiting the available range of skewer assemblies from receiving yarn tubes having larger diameters.

SUMMARY OF THE INVENTION

Accordingly, it is an object of the present invention to provide a novel skewer assembly for use on a spool winding machine or spooler having means to hold and release hollow cylindrical or tapered tubes, cops, or pirns which are made of paper, wood, plastic, metal or the like, and which facilitate wound layers of yarn of a predetermined length to be subsequently transferred to larger sized spools or cones.

Another object of the present invention is to provide a skewer assembly which will reduce yarn wastage, working cost and concurrently enhance continuous and uninterrupted production.

A further object of the present invention is to produce a novel structure which will eliminate damage to yarn tubes and other parts of the skewer assembly, and to other adjoining portions of the machine.

Still another object of the invention is to provide a novel skewer assembly for spool winding machines of the Barber Colman type.

BRIEF DESCRIPTION OF THE DRAWINGS

Reference may now be had to the following detailed description of exemplary embodiments of the invention, taken in conjunction with the accompanying drawings; in which:

FIGS. 7 and 8 respectively show front elevational and plan views of a skewer dog;

FIG. 9 illustrates a prior art skewer tip construction;

FIG. 10 is a sectional view taken along line 10—10 in FIG. 9;

FIG. 11 is a skewer tip construction according to the present invention;

FIG. 12 is a sectional view taken along line 12—12 in FIG. 11;

DETAILED DESCRIPTION

Figure 5:
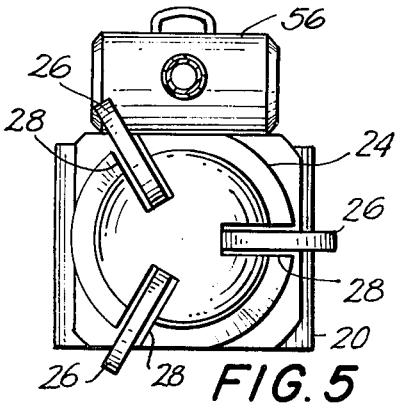
FIG. 5 is a top plan view of the skewer assembly of FIG. 3.
Figure 1:
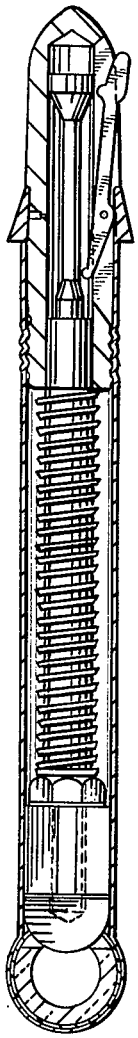
FIG. 1 PRIOR ART
FIG. 1 is a sectional view of a prior art skewer assembly.
Figure 3:
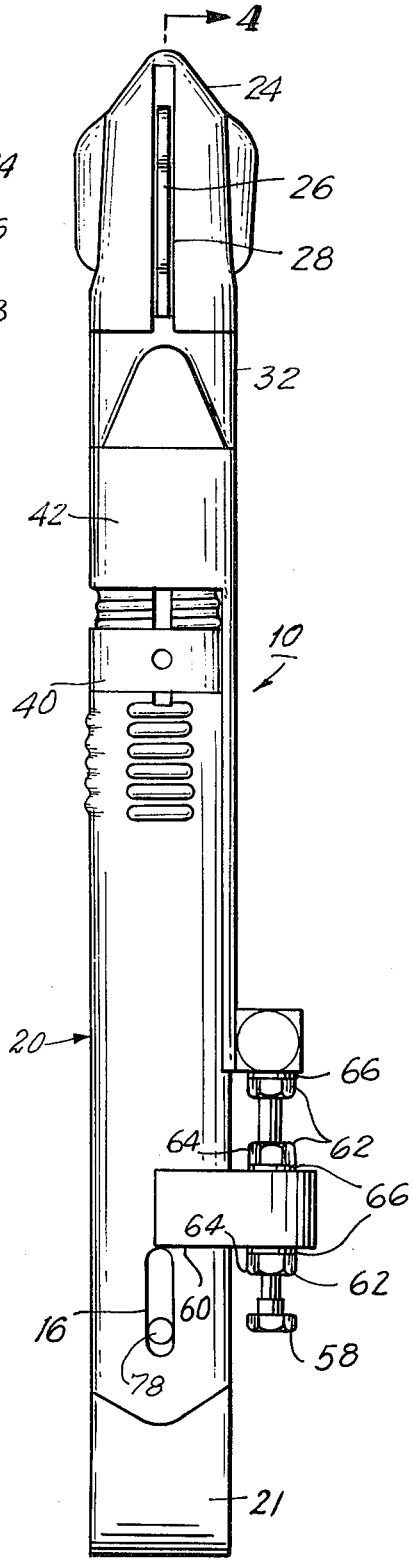
FIG. 3 is a front elevational view of a skewer assembly according to the invention.
Figure 4:
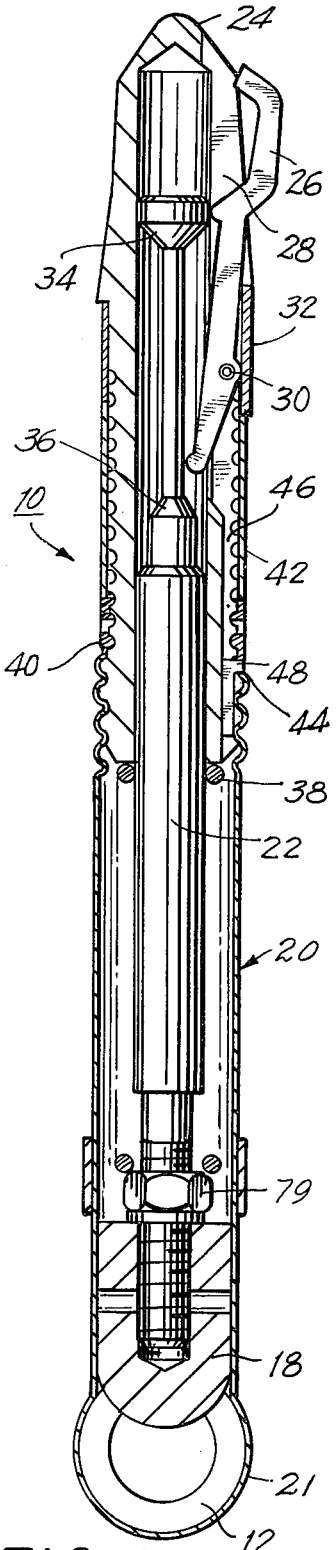
FIG. 4 is a sectional view taken along line 4—4 in FIG. 3.
Figure 2:
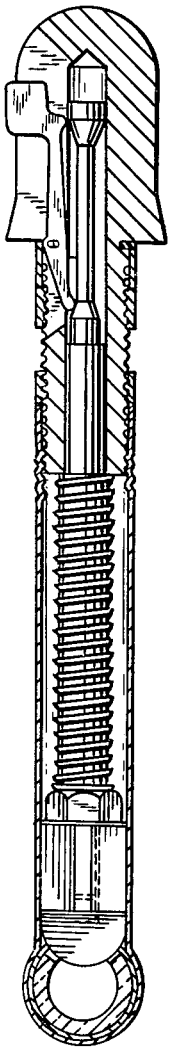
FIG. 2 PRIOR ART
FIG. 2 is a sectional view of another prior art skewer assembly.
Figure 6:
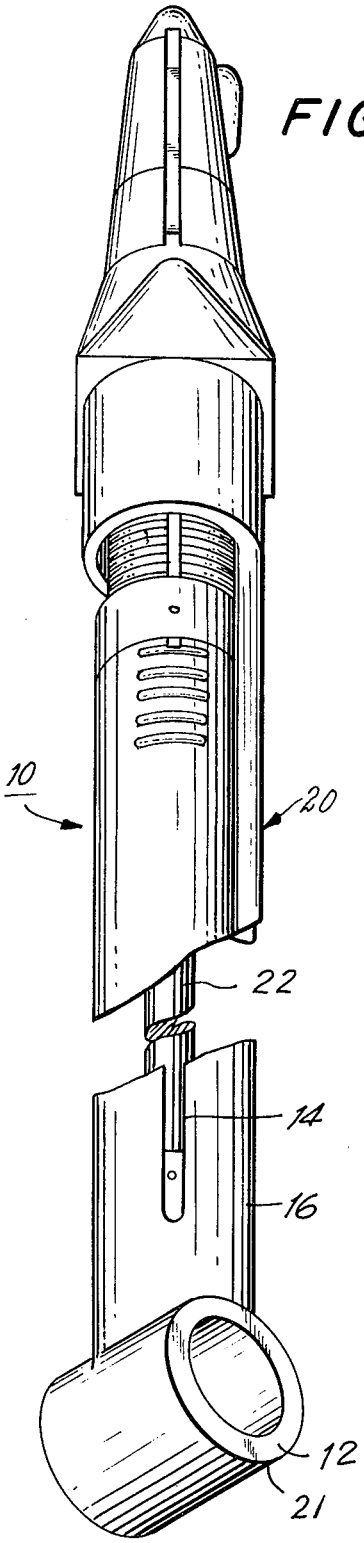
FIG. 6 is a perspective view of the skewer assembly of FIG. 3.

Referring to the drawings, a skewer assembly 10, as shown in FIGS. 3 to 6, has an upper end portion 24 which is threaded on a lower tubular portion 20. The lower end of tubular portion 20 is formed with a tubular sleeve 21 carrying a slotted bush 12 which is mounted on a horizontal camming crank pin of the Barber Colman machine as is well known in the art. The tubular portion 20 has a groove or slot 14 provided in a portion 16 which receives a cam 18, which rides in portion 16 and is actuated by the crank pin in sleeve 20, said cam being inserted through a slot in bush 12. A guide pin 78 on cam 18 rides in slot 14. The cam 18 is threadably connected to a spindle 22 and secured by a lock nut 79. The top part of the skewer assembly, which is threaded in portion 20, passes between two stationary guide shafts (not shown) which extend parallel to each other, one in front and the other at the back of the skewer assembly.

The front guide shaft is positioned a little lower than the back guide shaft, immediately below the slot in the bobbin pocket. These guide shafts and the slot extend at right angles to each other so as to allow sections of limited dimensions to travel therebetween.

The circular motion of the crank is converted by these shafts into upwards, downwards, backwards and again upwards movements of the skewer assembly through the slot in the bobbin pocket. The rotary motion of the round stud of the crank within the bush 12 alternately raises and lowers the cam 18.

The upward movement of the cam 18 through the bush 12 raises the spindle 22 up in the tipped skewer end 24 which is screwed onto the skewer tube 20. Skewer dogs 26 are inserted through guide slots 28 formed in the tipped skewer end 24 and held in position by dowels 30 provided within the slots and by a conical spacer 32 from the outside. The dogs 26 are forced inwardly by the raising of the spindle 22 and are actuated by the two conical cams 34 and 36 of the spindle 22, these cams being in constant engagement with the dogs 26. A spring 38 normally forces the spindle 22 down which, in turn, pushes the dogs 26 radially outwardly. These movements of the dogs 26 hold and release the yarn tubes (not shown) when the latter are inserted over the tip 24 of the skewer assembly either manually or automatically. The conical spacer 32 determines the position and maximum diameter of the bore of the yarn tube which is adapted to be held by the skewer assembly. The conical spacer is held in position by a lock nut 40 threadably mounted on the portion 24 of the skewer assembly. A cylindrical plain ring-type spacer 42 is inserted between the conical spacer 32 and the lock nut 40. The skewer tip portion 24 has a threaded end which is screwed into tube 20 and is held by lock nut 40. Clockwise or counterclockwise movement of the skewer tip portion 24 is prevented by a right-angled key 44 inserted in a keyway 46 provided on the threaded end of the tip portion 24, and maintained in a slot 48 in the skewer tube 20 by the lock nut 40.

In order to effect the full ejection of the tube, when released in an upright position, the skewer assembly must be lowered down through the slot in the bobbin pocket in which the assembly is held. This is required in order to strip the yarn tube off the skewer assembly. The spacer 32 has a diameter which is larger than the internal diameter of the yarn tube so as to effectively hold the tube in position. To facilitate the travel of the spacer 32 through the slot of the bobbin pocket, portions extending in parallel to the two sides of the slot are machined off the spacer 32.

A prior art dog is provided with a flat head and has short length in contrast with the dog of the invention, and this dog is improved upon by extending the length thereof as shown in FIGS. 7 and 8. This extended length of the dog aids in eliminating the need for a larger number of different kinds of skewer assemblies, and reduces the chances or danger of the tube being gripped at an angle in a tilted or inclined position out of line of the draw of the yarn which would result in excessive knocking and rubbing of the passing yarn at the top of the tube, thereby creating yarn breakage and resulting in wasted yarn remaining at the bottom of the tube, which adversely would effect efficiency and production.

The inventive skewer dog imparts a greater degree of expansion and contraction to the skewer assembly as against a comparatively smaller expansion and contraction by a dog in a conventional or prior art skewer assembly. The bent and convex extending head H of the dog acts as a sliding guide for the entering yarn tube and as a guard against undesired trapping of yarn tubes since it does not leave any gap between the tip 24 and the dog 26 itself. The portion marked ($H^1$) is also made convex by rounding off the bottom corner of the dog so as to ensure a gradual, smooth and jerkless ejection of the yarn tube.

The common circular groove 52 as shown along line 10—10 in FIG. 9 is provided on a prior art assembly for receiving the dowel pin 30 of the dog 26. In the present invention, this circular groove is eliminated and in lieu thereof there is provided a deep straight slot 54 as shown on line 12—12 in FIG. 11, for each dog individually. As seen the end portion 24 in FIG. 11 is formed with the tapered tip end and the threaded stem 53 of uniform diameter which forms cylindrical shoulder 55 with the tip end. With this improvement, there is provided a much thicker section adjoining the slot 54 so as to impart sufficient strength to the tip portion 24 of the skewer assembly 10, which makes it possible for the latter to retain yarn tubes having larger bore diameters.

Figure 17:
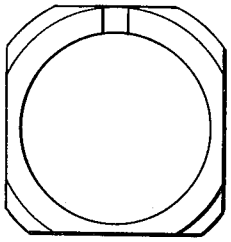
FIG. 17 is a plan view of a notched spacer.
Figure 18:
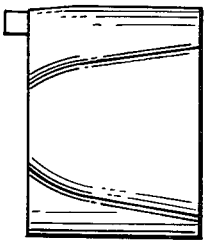
FIG. 18 is a side view of the spacer of FIG. 17.

A plain conical collar type spacer is designed and an indenture is introduced as shown in FIGS. 17 and 18. This indenture is suitably positioned so as to project out and engage with adjoining parts secured to the spacer on the skewer tip portion. This indenture prevents the interruption of the setting of the position of the spacer and thus eliminates breakdowns. The indented surface may be made as an integral part of the spacer body, which is machined to size or may be fixed thereto by any suitable means. In the alternative, a slot or slots may be formed on the conical spacer adapted to receive pins, dowels, notches, or projections of the adjoining parts for the above-mentioned purpose.

In order to further increase the distance between the grip line of the dogs 26 and the bottom supported line of the conical spacer 32, the front and back portions of the spacer 32 parallel with the guide shafts and at right angles to the slot in the bobbin pocket, must be suitably machined away. This makes it possible to set the spacer 32 at a lower height on the skewer assembly, and to thereby increase the grip height. Because of its front, back and side portions being cut off, there is reduced the peripheral surface of contact between the yarn tube bottom inside and the spacer outside so that yarn tubes, which are often deformed due to mishandling during transit and which are usually seated tilted or inclined on the skewer assembly, may also be received upright on the skewer assembly.

The possibility of the lock nut 40 at the top frequently being loosened so as to thereby allow the spacer 32 to slide down and become disengaged from the slot of the tip 24, and to thereby result in the spacer 32 freely turning around and causing damage, is totally eliminated by an adjustable extended-arm spacer 56 which is substituted in place of a conventional round ring and lock nut. The spacer is so designed as to maintain itself within allowable limits. This arm is secured to the skewer tube 20 so that it does not hamper the normal travel and operation of the skewer assembly 10. A stud 58 controls the upward and downward movements of this extended-arm spacer 56. The stud 58 is inserted through a holder 60 which is attached to the skewer tube 20 and is secured in position by a lock nut 62 or a spring. The stud 58 is secured by means of nuts 64 and washer 66.

Figure 13:
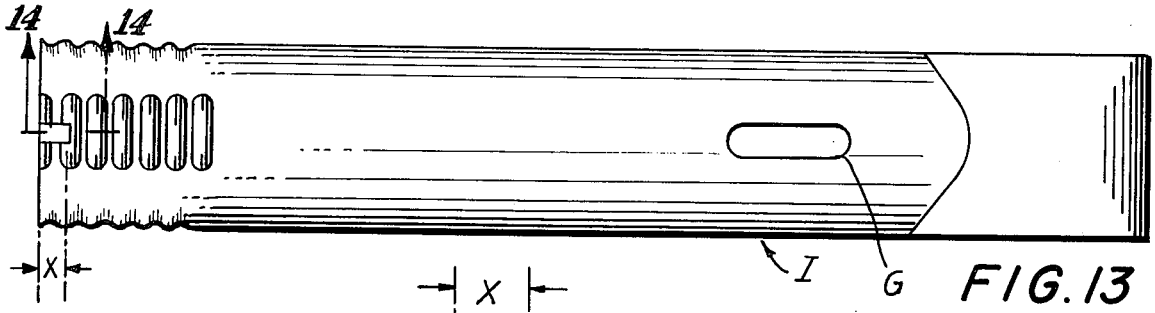
FIG. 13 illustrates a skewer tube.
Figure 14:
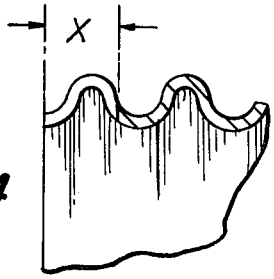
FIG. 14 is an enlarged fragmentary section of the skewer tube portion showing a key slot X along line 14—14 in FIG. 13.
Figure 15:
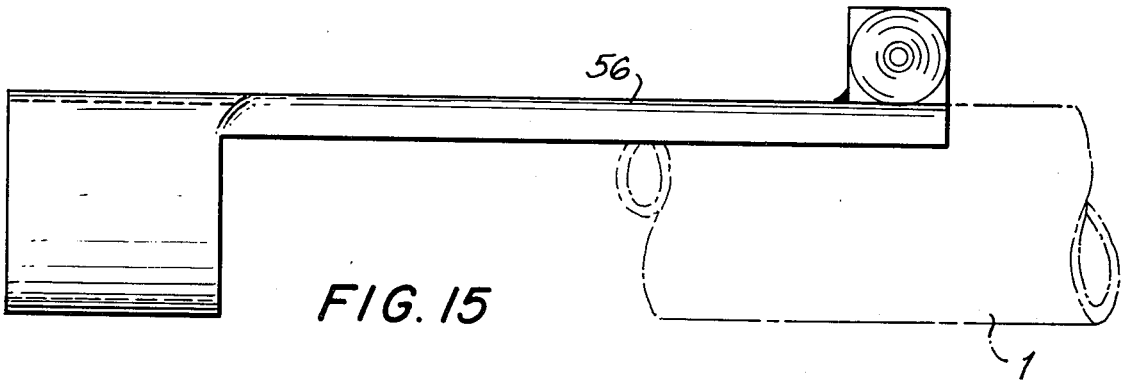
FIG. 15 shows an adjustable-arm spacer for the skewer assembly.
Figure 16:
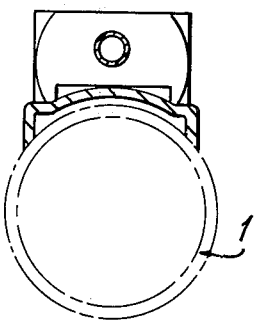
FIG. 16 is a plan view of the spacer of FIG. 15.

The slot X for the right angled-key 44, the latter which is introduced into a groove forming the part of the threaded portion of the skewer tube 1 (FIG. 13) is shown in enlarged scale in FIG. 14 taken along the line 14—14 in the FIG. 13, is adapted to receive the tip portion 24. The straight side of the slot is eliminated by a semi-circular groove G which, being stronger than a straight sided groove, prevents the widening of the slot. This surface is given a hardening heat treatment to reduce wear and tear. The head of the key 44 is maintained flush with the outside diameter of the skewer tube 20 to avoid impacting against and dragging of the right-angled head of the key 44. This semi-circularly sided groove G is located in the top surface of the skewer assembly in such a manner so that a sharp-pointed instrument may be readily introduced therein to easily pull out the key 44.

While there has been shown what is considered to be the preferred embodiment of the invention, it will be obvious that modifications may be made which come within the scope of the disclosure of the specification.

What is claimed is:

1. A skewer assembly comprising upper and lower tubular portions connected together and extending axially along a longitudinal axis, said upper portion having a tapered end, said lower portion having an end with bearing means for a rotatable crank pin, longitudinal cam means riding in said lower portion and actuated by the crank pin, said upper portion being provided with a plurality of longitudinal guide slots distributed around the circumference of the upper portion, holding dogs pivotably mounted on said upper portion for movement in respective guide slots in said upper portion, actuation means extending in said tubular portions and coupled to said camming means for acting on said holding dogs to pivotably move the same between extended and retracted positions for selectively holding and releasing a bobbin on the skewer, each of said dogs including a first end region with a convexly bent portion with an extremity extending obliquely relative to said longitudinal axis radially inwardly and axially upwardly to form a guide for a bobbin as it is received by said skewer assembly.

2. A skewer assembly as claimed in claim 1 wherein each said dog includes an intermediate portion with an inclined part joined to said first end region, said inclined part extending radially outwards and axially upwards.

3. A skewer assembly as claimed in claim 2 wherein said inclined part is joined to said first end region with an external convex surface.

4. A skewer assembly as claimed in claim 1 wherein said lower portion has a longitudinal slot thereon, and said cam means includes a guide pin riding in said slot in said lower portion.

5. A skewer assembly as claimed in claim 1 comprising key means engaging said upper and lower portions preventing relative rotation therebetween.

6. A skewer assembly as claimed in claim 1 wherein said upper and lower tubular portions are threadably engaged together, said assembly further comprising spacer means for coupling said upper and lower tubular portions in adjusted threaded relation.

7. A skewer assembly as claimed in claim 6 wherein said spacer means comprises a first spacer loosely on said upper portion, and means for holding said spacer on said upper portion to prevent lowering of said spacer.

8. A skewer assembly as claimed in claim 7 wherein said means for holding said first spacer on said upper portion comprises a second spacer loosely on said upper portion and adjustably coupled to said lower portion.

9. A skewer assembly as claimed in claim 8 wherein said second spacer includes a longitudinally extending arm, said assembly further comprising means threadably connecting said arm to said lower portion.

10. A skewer assembly as claimed in claim 9 wherein said first spacer comprises a conical collar surrounding said upper portion, and said second spacer comprises a cylindrical collar surrounding said upper portion, said arm extending longitudinally downwards from said cylindrical collar.

11. A skewer assembly as claimed in claim 1 wherein said upper portion includes a plug threadably engaged in said lower portion, said guide slots being formed in said plug, and dowels carried by said plug and pivotably supporting said dogs.

12. A skewer assembly as claimed in claim 24 wherein said plug includes a tapered end portion, and a threaded stem of substantially uniform diameter extending from said tapered end portion, said end portion and stem forming a cylindrical shoulder.

13. A skewer assembly as claimed in claim 1 wherein said actuating means comprises an axial spindle extending in said portions, said stem being coupled to said camming means and including conical portions engageable with said dogs to pivotably move the same.

* * * * *